US011448223B2

(12) United States Patent
Kabasawa

(10) Patent No.: US 11,448,223 B2
(45) Date of Patent: Sep. 20, 2022

(54) VACUUM PUMP AND SPIRAL PLATE, SPACER, AND ROTATING CYLINDRICAL BODY EACH INCLUDED VACUUM PUMP

(71) Applicant: Edwards Japan Limited, Chiba (JP)

(72) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 826 days.

(21) Appl. No.: 16/336,006

(22) PCT Filed: Sep. 29, 2017

(86) PCT No.: PCT/JP2017/035471
§ 371 (c)(1),
(2) Date: Mar. 22, 2019

(87) PCT Pub. No.: WO2018/066471
PCT Pub. Date: Apr. 12, 2018

(65) Prior Publication Data

US 2020/0025206 A1 Jan. 23, 2020

(30) Foreign Application Priority Data

Oct. 6, 2016 (JP) ..... JP2016-198102

(51) Int. Cl.
*F04D 19/04* (2006.01)
*F04D 29/32* (2006.01)
(Continued)

(52) U.S. Cl.
CPC ..... *F04D 19/04* (2013.01); *F04D 29/322* (2013.01); *F04D 29/324* (2013.01);
(Continued)

(58) Field of Classification Search
CPC .... F04D 29/322; F04D 29/324; F04D 29/284; F04D 29/544
See application file for complete search history.

(56) References Cited

U.S. PATENT DOCUMENTS 4,893,985 A 1/1990 Holss
8,172,515 B2 5/2012 Kawashima et al.
(Continued)

FOREIGN PATENT DOCUMENTS

CN 102536853 A 7/2012
JP 2007002692 A 1/2007
(Continued)

OTHER PUBLICATIONS

PCT International Search Report dated Dec. 19, 2017 for corresponding PCT Application No. PCT/JP2017/035471.
(Continued)

*Primary Examiner* — Kenneth J Hansen
(74) *Attorney, Agent, or Firm* — Theodore M. Magee; Westman, Champlin & Koehler, P.A.

(57) ABSTRACT

In a vacuum pump, an outer diameter of a spiral plate disposed on a downstream side is set smaller than an outer diameter of a spiral plate disposed on an upstream side. Specifically, a stepped portion is provided by setting a blade length of the spiral plate disposed on the downstream side shorter than a blade length of the spiral plate disposed on the upstream side. In addition, in a spacer provided in the stepped portion, a relief formation portion is provided to allow a contact surface in contact with an upstream spacer (i.e., spacer opposed to the spiral plate having the unreduced outer diameter) and a contact surface in contact with a downstream spacer (i.e., spacer opposed to the spiral plate having the reduced outer diameter) in the stepped portion to have an equal inner diameter.

2 Claims, 8 Drawing Sheets

(51) Int. Cl.
*F04D 29/38* (2006.01)
*F04D 29/54* (2006.01)

(52) U.S. Cl.
CPC ..... *F04D 29/384* (2013.01); *F04D 29/544* (2013.01); *F05D 2210/12* (2013.01); *F05D 2240/20* (2013.01)

(56) References Cited

U.S. PATENT DOCUMENTS

| | | | | |
|---|---|---|---|---|
| 2009/0116959 | A1* | 5/2009 | Sakaguchi ..... | F04D 29/644 415/208.2 |
| 2015/0037137 | A1 | 2/2015 | Schofield et al. | |

FOREIGN PATENT DOCUMENTS

| | | | |
|---|---|---|---|
| JP | 2011027049 | A | 2/2011 |
| JP | 2016017454 | A | 2/2016 |
| WO | 2009028099 | A1 | 3/2009 |

OTHER PUBLICATIONS

PCT International Written Opinion dated Dec. 19, 2017 for corresponding PCT Application No. PCT/JP2017/035471.
Communication dated May 4, 2020 and Supplementary European Search Report dated Apr. 24, 2020 for corresponding European Patent Application No. 17858309.2.

* cited by examiner

VACUUM PUMP AND SPIRAL PLATE, SPACER, AND ROTATING CYLINDRICAL BODY EACH INCLUDED VACUUM PUMP

CROSS-REFERENCE OF RELATED APPLICATION

This application is a Section 371 National Stage Application of International Application No. PCT/JP2017/035471, filed Sep. 29, 2017, which is incorporated by reference in its entirety and published as WO 2018/066471 A1 on Apr. 12, 2018 and which claims priority of Japanese Application No. 2016-198102, filed Oct. 6, 2016.

BACKGROUND

The present invention relates to a vacuum pump and to a spiral plate and a spacer each included in the vacuum pump.

More particularly, the present invention relates to a vacuum pump which reduces a stress generated in a spiral plate disposed on a downstream side thereof and to the spiral plate and a spacer each included in the vacuum pump.

In a vacuum pump for performing a vacuum exhaust process in a vacuum chamber disposed in the vacuum pump, a gas transfer mechanism is contained as a structure including a rotor portion and a stator portion to perform an exhausting function.

Such gas transfer mechanisms include a type configured to compress a gas using an interaction between spiral plates disposed in the rotor portion and stator discs disposed in the stator portion.

Japanese Translation of PCT Application No. 2015-505012 describes a technique in which spiral plates (such as spiral blades 30) are disposed on a side surface of a rotating cylinder of a vacuum pump and, in at least one slot 40 (configuration referred to as slit in a description of the present application) provided in each of the spiral plates, a stator disc (such as a perforated intersecting element 14) provided with hole portions (such as perforated holes 38) in the form of an array is disposed, FIG. 7 is a view for illustrating an existing vacuum pump 1000 including a stator disc 10 in which such hole portions in the form of an array as described above are provided.

FIG. 8 is a view for illustrating an existing composite-type vacuum pump 1100 including the stator disc 10 in which such hole portions in the form of an array as described above are provided.

As shown in FIG. 7, in the existing vacuum pump 1000, spiral plates 9 disposed on upstream and downstream sides thereof are configured to have equal outer diameters.

As shown in FIG. 8, in the existing composite-type vacuum pump 1100 including a turbo molecular pump portion T and a thread-groove pump portion S also, the spiral plates 9 disposed on upstream and downstream sides thereof are configured to have equal outer diameters.

The discussion above is merely provided for general background information and is not intended to be used as an aid in determining the scope of the claimed subject matter. The claimed subject matter is not limited to implementations that solve any or all disadvantages noted in the background.

SUMMARY

The vacuum pump 1000 (1100) having such a configuration has such a stress-related problem to be solved as described below.

To improve the exhausting ability of the vacuum pump 1000 (1100), it is generally desirable to adopt a configuration in which an angle formed between an upstream surface (spiral surface) of each of the spiral plates 9 and a horizontal surface (virtual line) is set larger on the upstream side of the vacuum pump (1000 or 1100) and set smaller on the downstream side thereof.

However, when the angle is reduced on the downstream side, a stress in a base (portion of the spiral plate 9 which is bonded to a rotor 8) of the spiral plate 9 may be increased (stress concentration).

Accordingly, it is necessary to reduce the stress by, e.g., limiting a winding number of the spiral plate 9 or by increasing the angle on the downstream side.

An object of the present invention is to provide a vacuum pump which reduces a stress generated particularly in a spiral plate disposed on a downstream side thereof and the spiral plate, a spacer, and a rotating cylindrical body each included in the vacuum pump.

The present invention in a first aspect provides a vacuum pump including: a housing in which an inlet port and an outlet port are formed; a rotating shaft enclosed in the housing and supported rotatably; spiral plates disposed in a spiral form on an outer peripheral surface of the rotating shaft or of a rotating cylinder disposed on the rotating shaft, and provided with at least one slit; a stator disc provided in the slit of the spiral plates, with a predetermined space from the slit, and having a hole portion penetrating the stator disc; spacers for fixing the stator disc; and a vacuum exhaust mechanism for transferring, to the outlet port, gas sucked from the inlet port by an interaction between the spiral plates and the stator disc. Outer diameters of the spiral plates become smaller after at least one of the slits serving as a boundary than before the slit.

The present invention in a second aspect provides the vacuum pump in the first aspect in which inner diameters of the spacers become smaller after at least one of the stator discs serving as a boundary than before the stator disc.

The present invention in a third aspect provides the vacuum pump in the second aspect in which at least one of the spacers opposed to each other via the stator disc has a relief formation portion which allows respective contact surfaces between the stator disc and the spacers to have an equal inner diameter.

The present invention in a fourth aspect provides the vacuum pump in the third aspect in which the relief formation portion has an inclined portion which is inclined downstream in at least a portion of a side surface thereof opposed to the spiral plate.

The present invention in a fifth aspect provides the vacuum pump in the third or fourth aspect in which a horizontal position of a lower end of the relief formation portion coincides with a horizontal position of an upstream surface of the spiral plate which is opposed to the spacer having the relief formation portion via a predetermined gap.

The present invention in a sixth aspect provides a spiral plate which is provided in the vacuum pump in any one of the first to fifth aspects.

The present invention in a seventh aspect provides a spacer which is provided in the vacuum pump in any one of the second to fifth aspects.

The present invention in an eighth aspect provides a rotating cylindrical body including the vacuum pump in the sixth aspect.

In accordance with the present invention, it is possible to reduce a stress particularly in a portion (base) of the downstream-located spiral plate 9 among the spiral plates disposed in the vacuum pump which is bonded to the rotor 8. This allows the downstream spiral plate to have an ideal angle.

As a result, it is possible to implement the vacuum pump having a high exhausting ability and low power consumption.

In addition, by forming a relief in a spacer located in a portion (stepped portion) resulting from an outer diameter reduction, it is possible to equalize a load applied to the stator disc 10 from thereabove and a load applied to the stator disc 10 from therebelow, the loads allowing the stator disc 10 to be held in-between. Accordingly, it is possible to reduce upstream warping (bending) of the stator disc 10. Moreover, since the flow of a gas passing through the stepped portion is allowed to be smoothed, deposition of a reaction product can be reduced.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

(i) Outline of Embodiments

In a vacuum pump according to each of embodiments of the present invention, outer diameters of spiral plates disposed therein are set smaller on a downstream side than on an upstream side. In other words, blade lengths of the spiral plates disposed on the downstream side are set shorter than blade lengths of the spiral plates disposed on the upstream side. The resulting portion is hereinafter referred to as a stepped portion.

In addition, of spacers opposed to the spiral plates having the outer diameters reduced as described above via predetermined clearances (spaces), the spacer disposed in the stepped portion is provided with a relief formation portion. By providing the spacer with the relief formation portion, it is possible to allow a contact surface in contact with the upstream spacer (i.e., spacer opposed to the spiral plate having the unreduced outer diameter) and a contact surface in contact with the downstream spacer (i.e., spacer opposed to the spiral plate having the reduced outer diameter) in the stepped portion to have equal inner diameters.

The relief formation portion formed in the spacer has at least one inner-diameter portion which is slightly inclined downstream.

The configuration described above can reduce a stress on the downstream side of the vacuum pump. The configuration described above can also reduce a cross-sectional area of an exhaust mechanism on the downstream side. As a result, it is possible to reduce power consumption of the vacuum pump.

(ii) Details of Embodiments

The following will describe the preferred embodiments of the present invention in detail with reference to FIGS. 1 to 6.

Figure 1:
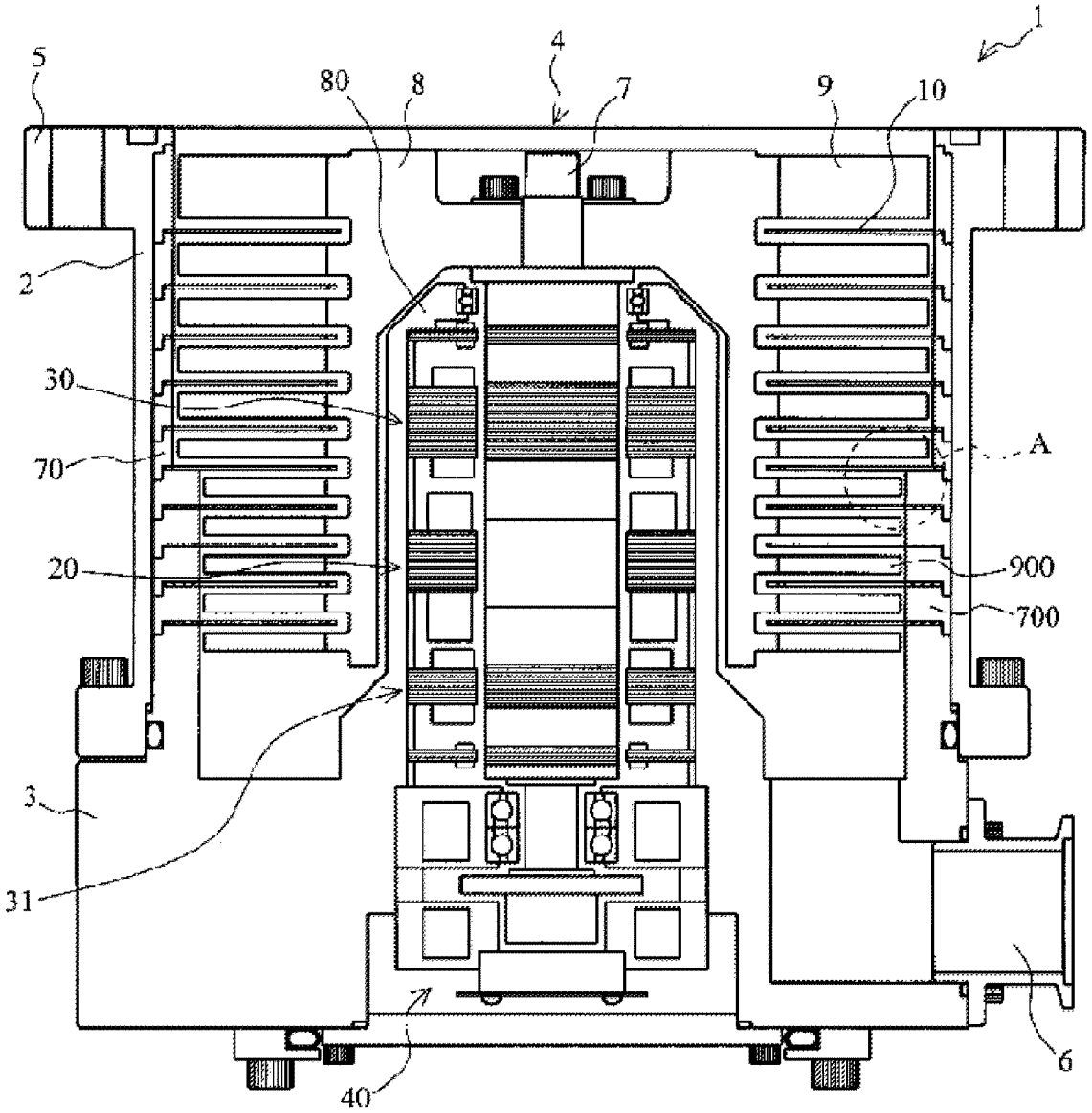
FIG. 1 is a view showing an example of a schematic configuration of a vacuum pump according to a first embodiment of the present invention.

FIG. 1 is a view showing an example of a schematic configuration of a vacuum pump 1 according to a first embodiment of the present invention, which shows a cross-sectional view of the vacuum pump 1 in an axis direction thereof.

Note that, in each of the embodiments of the present invention, for the sake of convenience, a description will be given on the assumption that a diametrical direction of a rotor blade is a "diameter (diametrical/radial) direction" and a direction perpendicular to the diametrical direction of the rotor blade is the "axis direction (or axial direction)".

A casing (outer cylinder) 2 forming a casing of the vacuum pump 1 has a generally cylindrical shape and is included in a housing of the vacuum pump 1 in conjunction with a base 3 provided in a lower portion (closer to an outlet port 6) of the casing 2. In the housing, a gas transfer mechanism as a structure which causes the vacuum pump 1 to perform an exhausting function is contained.

In the present embodiment, the gas transfer mechanism is basically configured to include a rotatably-supported rotor portion (rotor component) and a stator portion (stator component) fixed to the housing.

In addition, although not shown in the figure, outside the casing of the vacuum pump 1, a control device which controls an operation of the vacuum pump 1 is connected to the vacuum pump 1 via a dedicated line.

In an end portion of the casing 2, an inlet port 4 for introducing a gas into the vacuum pump 1 is formed. Around an end surface of the casing 2 closer to the inlet port 4, a radially outwardly protruding flange portion 5 is formed.

In the base 3, the outlet port 6 for exhausting the gas from the vacuum pump 1 is formed.

Of the gas transfer mechanism, the rotor portion includes a shaft 7 as a rotating shaft, a rotor (rotating cylindrical body) 8 disposed around the shaft 7, a plurality of spiral plates 9 provided on the rotor 8, and a plurality of spiral plates 900 provided on the rotor 8.

Each of the spiral plates 9 and the spiral plates 900 is formed of a spiral disc member extending radially from an axis line of the shaft 7 and extending so as to form a spiral flow path. Note that, in the disc member, at least one slit is formed in a horizontal direction relative to the axis line of the shaft 7.

In the present embodiment, the spiral plates 900 having blade lengths (radial lengths) shorter than those of the spiral plates 9 provided closer to the inlet port 4 (on the upstream side) are provided closer to the outlet port 6 than (on the downstream side of) a stepped portion serving as a boundary.

Note that the spiral plates 900 may be either configured to be formed integrally with the rotor 8 or configured to be placed as separate components on the rotor 8.

At about a middle of the shaft 7 in the axis direction, a motor portion 20 for rotating the shaft 7 at a high speed is provided and enclosed in a stator column 80.

In the stator column 80, radial magnetic bearing devices 30 and 31 for supporting the shaft 7 in a radial direction (diametrical direction) in non-contact relation are also provided to be closer to the inlet port 4 and the outlet port 6 than the motor portion 20 of the shaft 7. At a lower end of the shaft 7, an axial magnetic bearing device 40 for supporting the shaft 7 in the axis direction (axial direction) in non-contact relation is provided.

Of the gas transfer mechanism, the stator portion is formed on an inner peripheral side the housing (casing 2).

In the stator portion, stator discs 10 spaced apart from each other by spacers 70 and spacers 700 each having a cylindrical shape and fixed are disposed.

Each of the stator discs 10 is a plate-like member in the form of a disc extending radially and perpendicularly to the axis line of the shaft 7 and has a hole portion (bore portion) as a hole formed to extend through at least one portion thereof. In the present embodiment, each of the stator discs 10 is formed in a circular shape by joining together semi-circular (incompletely circular) members. On the inner peripheral side of the casing 2, the stator discs 10 and the spiral plates 9 are alternately disposed in the axis direction to form a plurality of pairs. Note that the number of the pairs may be determined appropriately by configuring the vacuum pump 1 such that an arbitrary number of the stator discs 10 and (or) an arbitrary number of the spiral plates 9 which satisfy the exhaust performance (discharge performance) requirement for the vacuum pump 1 are provided.

Each of the spacers 70 and the spacers 700 is a fixing member having a cylindrical shape. The stator discs 10 in the individual pairs are spaced apart from each other by the spacers 70 and the spacers 700 to be fixed.

In the present embodiment, the spacers 700 having inner diameters smaller than those of the spacers 70 provided closer to the inlet port 4 (on the upstream side) are provided closer to the outlet port 6 than (on the downstream side of) the stepped portion serving as the boundary.

Such a configuration allows the vacuum pump 1 to perform a vacuum exhaust process in a vacuum chamber (not shown) disposed in the vacuum pump 1.

First Embodiment

Figure 2:
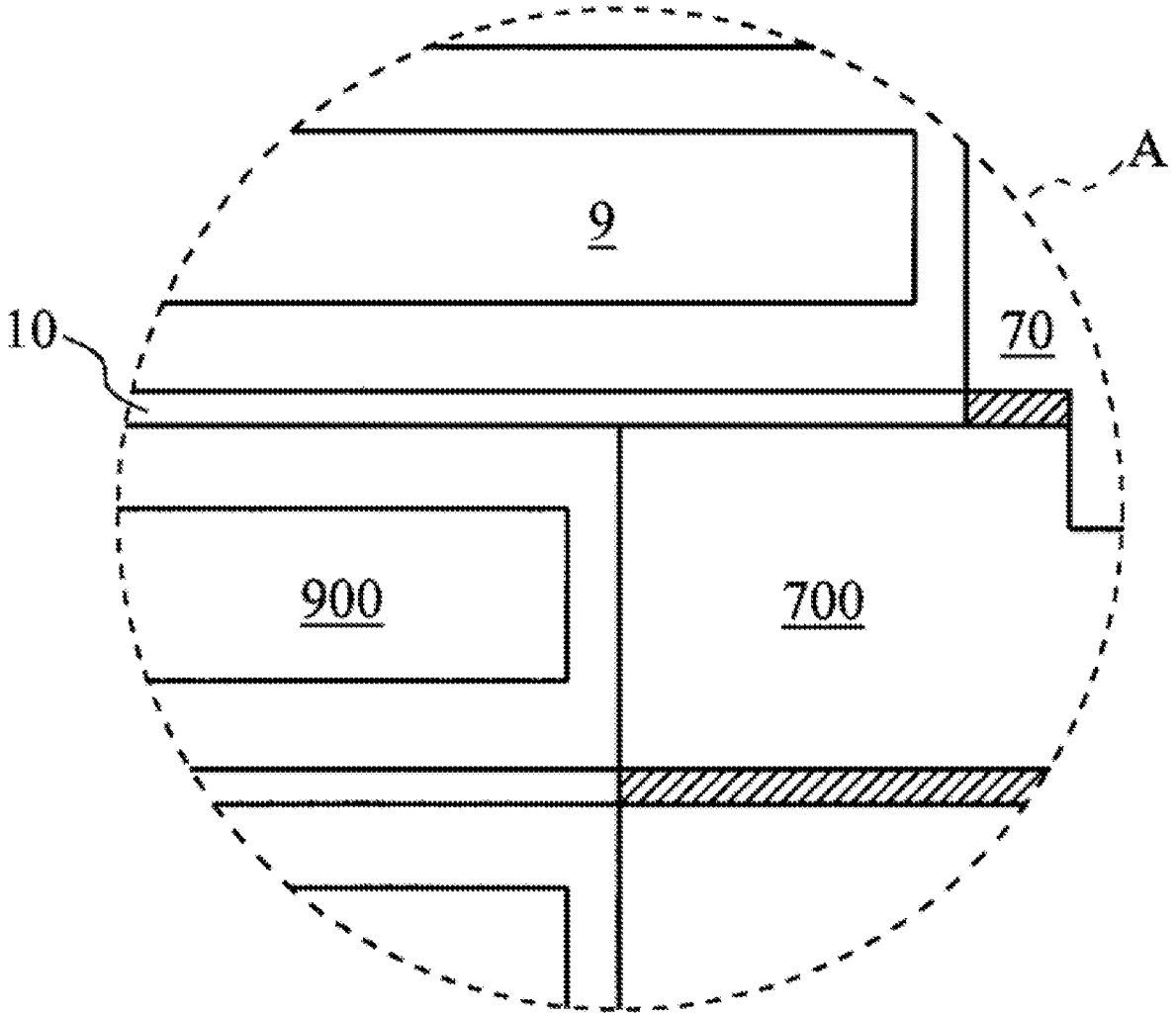
FIG. 2 is a view for illustrating spiral plates and spacers according to the first embodiment of the present invention.

With reference to FIG. 2, a description will be given of the spiral plates 900 and the spacers 700 which are disposed in the vacuum pump 1 described above.

FIG. 2 is a view for illustrating the spiral plates 900 and the spacers 700 according to the first embodiment of the present invention, which is an enlarged view of the vicinity of the stepped portion shown by a dotted line A in FIG. 1.

As shown in FIG. 2, the spiral plates 900 having blade lengths shorter than those of the spiral plates 9 disposed on the upstream side (closer to the inlet port 4) are disposed on the downstream side (closer to the outlet port 6). In the present first embodiment, the blade lengths of the spiral plates are shorter below any slit formed in the spiral plate 9 serving as a boundary than above the slit. It is assumed that the first and subsequent spiral plates having the shorter blade lengths (on the downstream side) are the spiral plates 900.

Note that the stepped portion resulting from a blade length change may also be provided at each of two or more locations.

Also, the spacers 700 having the inner diameters smaller than those of the spacers 70 provided on the upstream side are disposed to be opposed to the spiral plates 900 via predetermined spaces (gaps/clearances). In other words, in the stepped portion, the stator disc 10 is configured to be held between the spacer 70 and the spacer 700 which have the different inner diameters.

This configuration in which the outer diameters of the spiral plates 900 disposed on the downstream side are set smaller than those of the spiral plates 9 disposed on the upstream side can reduce a stress formed in each of the downstream spiral plates 900 of the vacuum pump 1. The configuration can also reduce the cross-sectional area of the exhaust mechanism on the downstream side. As a result, it is possible to the power consumption of the vacuum pump 1.

Second Embodiment

Figure 3:
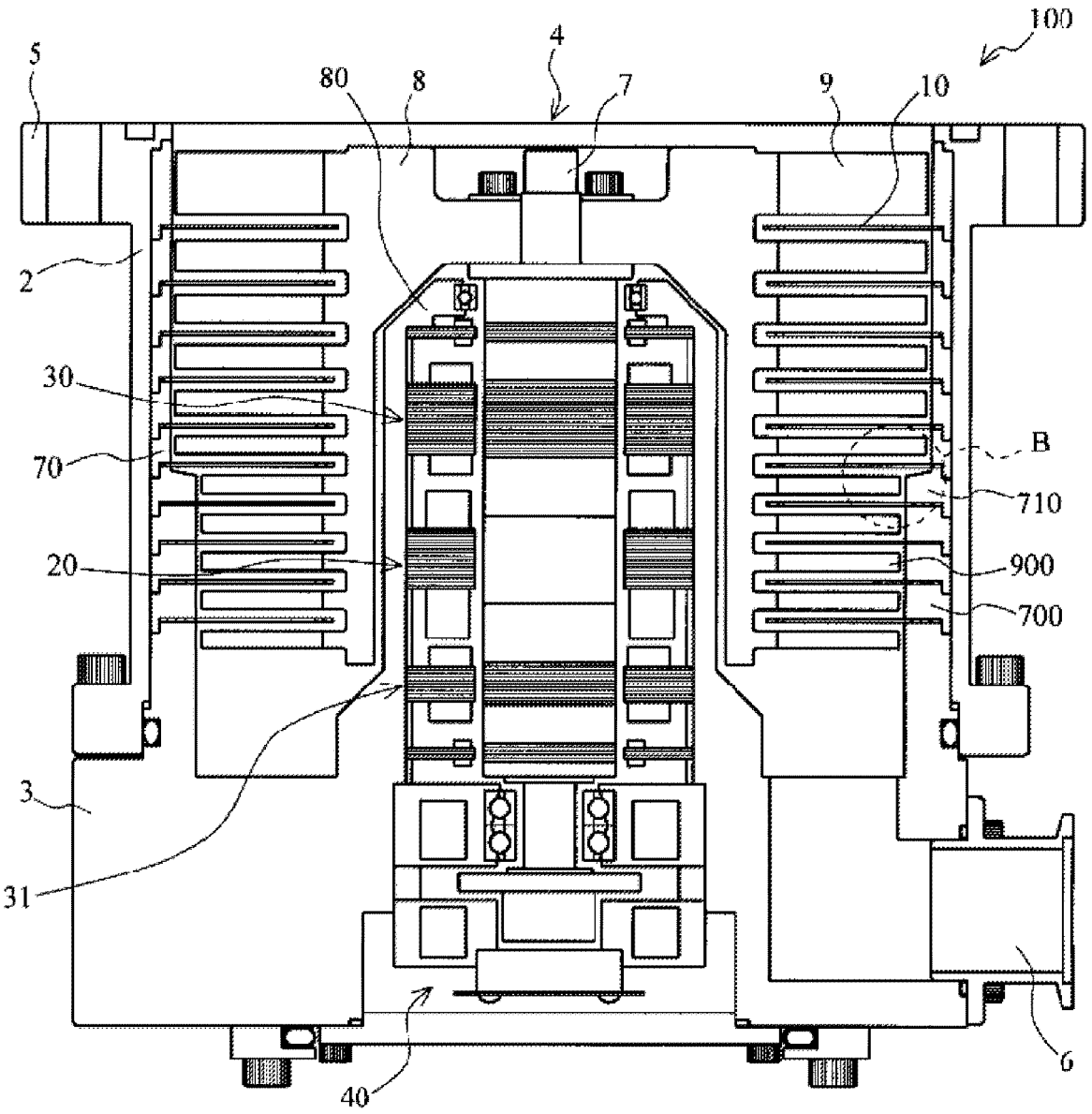
FIG. 3 is a view showing an example of a schematic configuration of a vacuum pump according to a second embodiment of the present invention.

FIG. 3 is a view showing an example of a schematic configuration of a vacuum pump 100 according to a second embodiment of the present invention.

Note that components equivalent to those in the first embodiment are given same reference numerals and a description thereof is omitted.

In the second embodiment, in the same manner as in the first embodiment described above, the spacers 700 having the inner diameters smaller than those of the spacers 70 provided on the upstream side are provided on the downstream side of the stepped portion serving as the boundary.

In the present second embodiment, spacers 710 are provided.

Note that, on the downstream side of spacers 710 described above, the same spacers 700 as in the first embodiment described above are provided.

Figure 4:
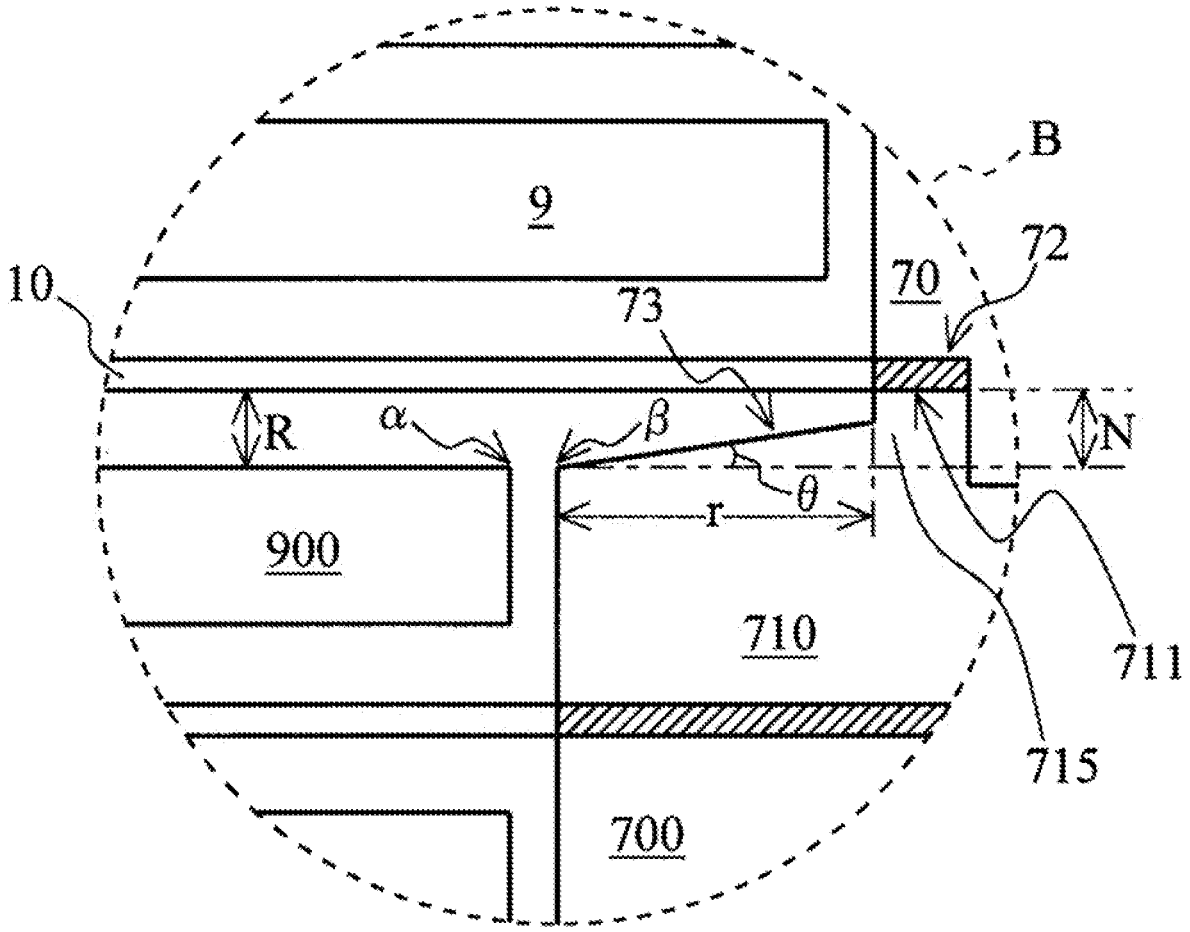
FIG. 4 is a view for illustrating spiral plates and spacers according to the second embodiment of the present invention.

FIG. 4 is a view for illustrating the spiral plate 900 and the spacer 710 according to the second embodiment of the present invention, which is an enlarged view of a stepped portion shown by a dotted line B in FIG. 3.

As shown in FIG. 4, in the present second embodiment, among the spacers 700 opposed to the spiral plates 900 via the predetermined spaces, the spacer 710 disposed in the stepped portion is provided with a relief formation portion 715 in which a relief N is to be formed.

The relief formation portion 715 can be formed by processing an upstream side of the spacer 710 such that a contact surface 72 in contact with each of the upstream spacer 70 (i.e., opposed to the spiral plate 9 having the unreduced diameter) and the stator disc 10 and a contact surface 711 in contact with each of the downstream spacer 710 (i.e., opposed to the spiral plate 900 having the reduced diameter) and the stator disc 10 in the stepped portion have equal contact areas.

In other words, in the present second embodiment, the stator disc 10 in the stepped portion has a configuration in which the stator disc 10 is held between the two spacers 70 and 710 having equal inner diameters on the upstream side and having different inner diameters on the downstream side.

The configuration in which an upper contact width (of the contact surface 72) and a lower contact width (of the contact surface 711) of the portion of the stator disc 10 which is held in-between are set equal allows the stator disc 10 to be equally pressed (held in-between) from thereabove and therebelow to be fixed. As a result, it is possible to reduce upstream warping (bending) of the stator disc 10 in the course of assembly in which the stator disc 10 is held in-between to be fixed or during exhaust.

In addition, a relief-formation-portion radially inner surface 73 as the surface of the relief formation portion 715 which is closer to the axial middle of the vacuum pump 100 is preferably configured to have at least one portion thereof slightly inclined in a downstream direction.

More specifically, as shown in FIG. 4, a configuration is adopted in which a radially horizontal surface and the relief-formation-portion radially inner surface 73 have an inclination angle θ therebetween. The inclination angle θ preferably has a value as large as possible within a range determined by a clearance with R between the stator disc 10 and the spiral plate 900 and a radial width r of the portion of the spacer 710 (relief formation portion 715) extending from the spacer 70 in the stepped portion.

The configuration having the inclination angle θ can smooth the flow of a gas passing through the stepped portion. Consequently, it is possible to reduce the deposition of a reaction product particularly in the vicinity of the relief-formation-portion radially inner surface 73 of the relief formation portion 715.

In addition, the configuration is preferably such that the position/height (shown by an arrow β) of the downstream terminal end (i.e., the lowermost surface of the relief formation portion 715 and shown by the lower one of the two dot-dash lines shown in FIG. 4) of the relief-formation-portion radially inner surface 73 which determines a depth of the stepped portion coincides with the position/height (shown by an arrow α) of the upstream surface of the spiral plate 900.

By configuring the relief formation portion 715 as described above, it is possible to make optimal use of an interaction occurring in a space formed between an axial side surface of the spacer 710 and an axial side surface of the spiral plate 900.

In each of the embodiments described above, the vacuum pump 1 (100) is provided with the one stepped portion (at one location), but the configuration is not limited thereto. It may also be possible to adopt a configuration in which the stepped portions are provided at two or more locations. Specifically, the configuration may also be such that spiral plates having blade lengths shorter than those of the spiral plates 900 are further provided downstream of the stepped portion formed by the spiral plate 900. In that case, the configuration of the spacers 700 (710) is also such that spacers having inner diameters smaller than those of the spacers 700 are provided downstream of the second stepped portion serving as a boundary.

Third Embodiment

Figure 5:
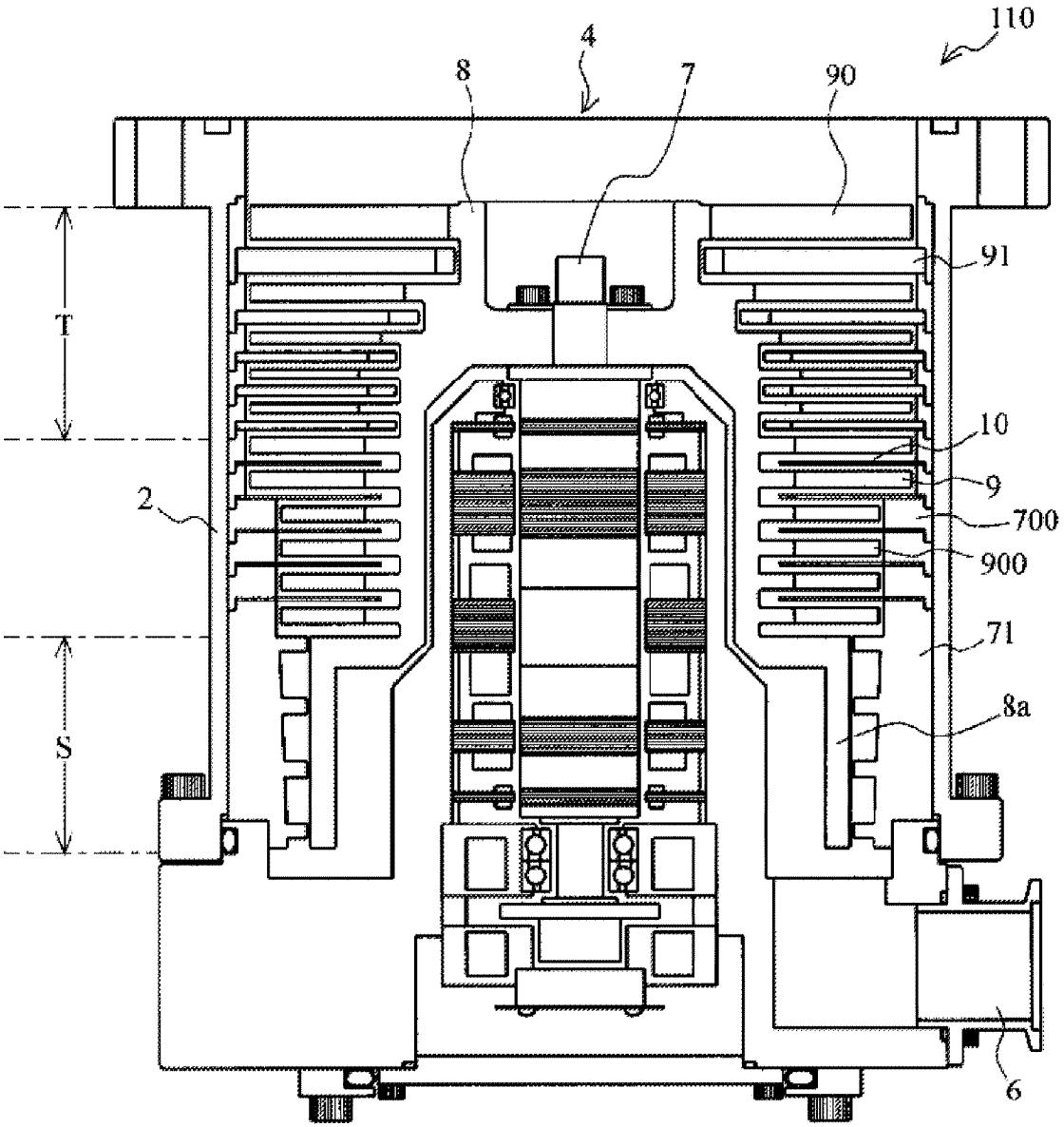
FIG. 5 is a view showing an example of a schematic configuration of a composite-type vacuum pump according to a third embodiment of the present invention.

FIG. 5 is a view showing an example of a schematic configuration of a composite-type vacuum pump 110 according to a third embodiment of the present invention.

In the composite-type vacuum pump 110 according to the third embodiment, a turbo molecular pump portion T is disposed closer to the inlet port 4, while a thread-groove pump portion S is disposed closer to the outlet port 6. Between the turbo molecular pump portion T and the thread-groove pump portion S, a configuration including the spiral plates 900 and the spacers 700 is disposed.

More specifically, the turbo molecular pump portion T has a plurality of rotor blades 90 and a plurality of stator blades 91 each having a blade-like shape and closer to the inlet port 4 in the rotor 8. The stator blades 91 are formed of blades each extending from the inner peripheral surface of the casing 2 toward the shaft 7, while being inclined at a predetermined angle from a plane perpendicular to the axis line of the shaft 7. The stator blades 91 and the rotor blades 90 are alternately disposed in the axis direction to form a plurality of pairs.

The thread-groove pump portion S includes a rotor cylindrical portion (skirt portion) 8*a* and a thread-groove exhaust element 71. The rotor cylindrical portion 8*a* is a cylindrical member having a cylindrical shape coaxial with a rotation axis of the rotor 8. The thread-groove exhaust element 71 has a thread groove (spiral groove) formed in the surface thereof opposed to the rotor cylindrical portion 8*a*.

The surface of the thread-groove exhaust element 71 opposed to the rotor cylindrical portion 8*a* (i.e., an inner peripheral surface thereof parallel with the axis line of the vacuum pump 110) is opposed to an outer peripheral surface of the rotor cylindrical portion 8*a* with a predetermined clearance being interposed therebetween. When the rotor cylindrical portion Sa rotates at a high speed, with the rotation of the rotor cylindrical portion 8*a*, a gas compressed by the composite-type vacuum pump 110 is transmitted toward the outlet port 6, while being guided by a thread groove. In other words, the thread groove serves as a flow path which transports the gas.

Thus, the surface of the thread-groove exhaust element 71 opposed to the rotor cylindrical portion 8*a* and the rotor cylindrical portion 8*a* are opposed to each other with the predetermined clearance being interposed therebetween to form the gas transfer mechanism in which the gas is transferred by the thread groove formed in the inner peripheral surface of the thread-groove exhaust element 71 in a direction of the axis line.

Note that, to reduce the force which causes a backward flow of the gas toward the inlet port 4, the clearance is preferably minimized.

A direction of the thread groove formed in the thread-groove exhaust element 71 corresponds to a direction in which a gas flows toward the outlet port 6 when transported in a direction of rotation of the rotor 8 in the thread groove.

A depth of the thread groove decreases with approach to the outlet port 6 so that the gas transported in the thread groove is increasingly compressed with approach to the outlet port 6.

The configuration described above allows the composite-type vacuum pump 110 to perform a vacuum exhaust process in a vacuum chamber (not shown) disposed in the vacuum pump 110.

The configuration of the composite-type vacuum pump 110 allows a gas compressed by the turbo molecular pump portion T to be subsequently compressed by the portion including the spiral plates 900 and the spacers 700 in the present embodiment and further compressed by the thread-groove pump portion S. Accordingly, it is possible to further enhance evacuation performance.

Fourth Embodiment

Figure 6:
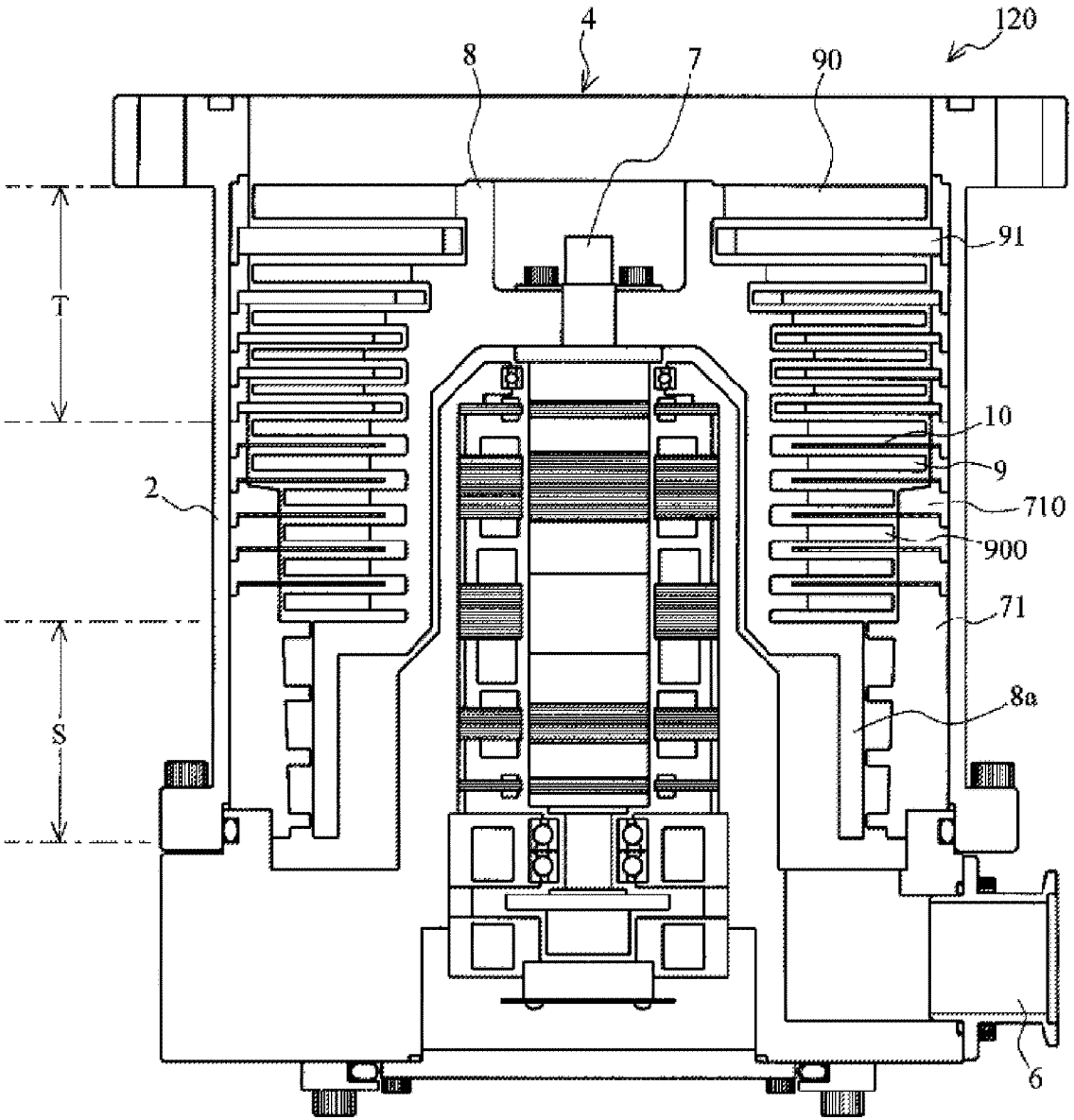
FIG. 6 is a view showing an example of a schematic configuration of a composite-type vacuum pump according to a fourth embodiment of the present invention.
Figure 7:
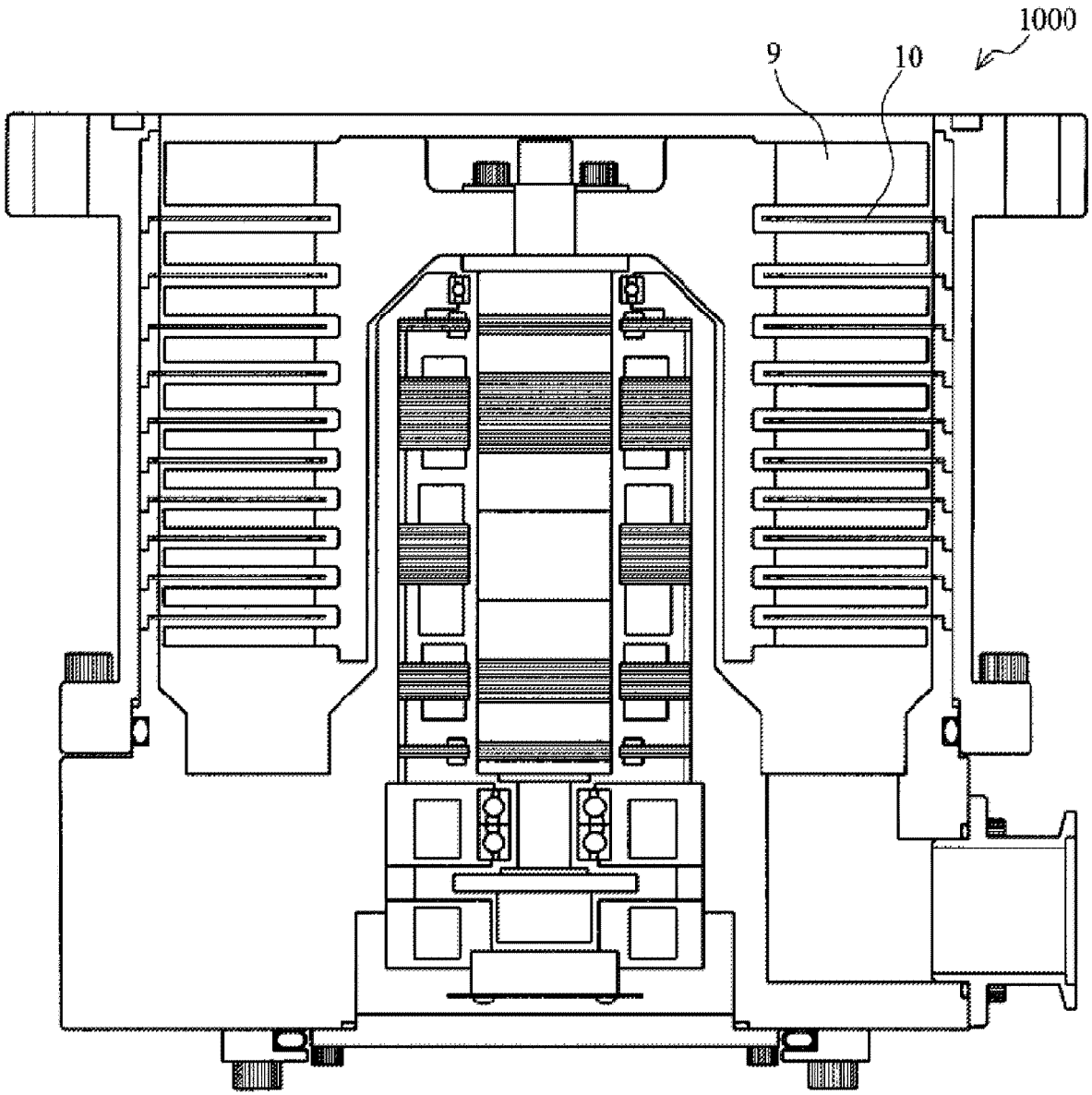
FIG. 7 is a view for illustrating a related-art technique.
Figure 8:
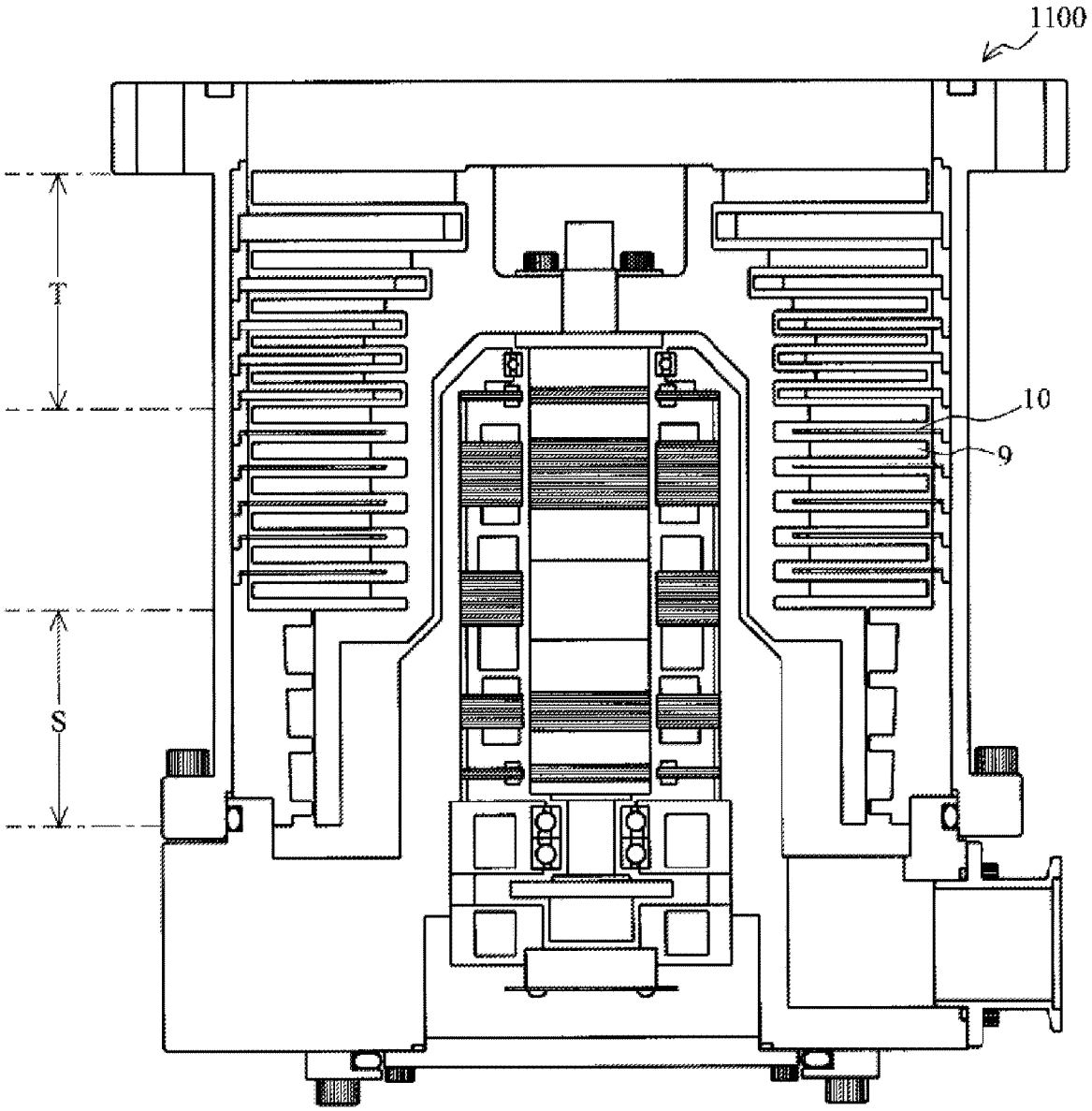
FIG. 8 is a view for illustrating the related-art technique.

FIG. 6 is a view showing an example of a schematic configuration of a composite-type vacuum pump 120 according to a fourth embodiment of the present invention.

Note that components equivalent to those in the third embodiment are given the same reference numerals and a description thereof is omitted.

In the composite-type vacuum pump 120 according to the fourth embodiment, the turbo molecular pump portion T is disposed closer to the inlet port 4, while the thread-groove pump portion S is disposed closer to the outlet port 6. Between the turbo molecular pump portion T and the thread-groove pump portion S, a configuration including the spiral plates 900, the spacers 710, and the spacers 700 which are described above is disposed.

The configuration of the composite-type vacuum pump 120 allows a gas compressed by the turbo molecular pump portion T to be subsequently compressed by the portion including the spiral plates 900, the spacers 710, and the spacers 700 in the present embodiment and further compressed by the thread-groove pump portion S. Accordingly, it is possible to further enhance evacuation performance.

The configuration in which the stepped portion is provided described above can reduce a stress generated in each of the spiral plates 900 on the downstream side of the vacuum pump 1 (100, 110, or 120) in each the embodiments of the present invention. The configuration can also reduce the cross-sectional area of the exhaust mechanism on the downstream side. As a result, it is possible to reduce the power consumption of the vacuum pump 1 (100, 110, or 120).

Note that the embodiments of the present invention and the individual modifications thereof may also be configured to be combined with each other as necessary.

Various modifications can be made to the present invention without departing from the spirit of the present invention. It should be clearly understood that the present invention is intended to encompass such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising:

a housing in which an inlet port and an outlet port are formed;

a rotating shaft enclosed in the housing and supported rotatably;

spiral plates disposed in a spiral form on an outer peripheral surface of the rotating shaft or of a rotating cylinder disposed on the rotating shaft, and provided with a slit having a first side and a second side;

a stator disc provided in the slit of the spiral plates, with a predetermined space from the slit, and having a hole portion penetrating the stator disc, the stator disc having a first side and a second side;

spacers for fixing the stator disc; and a vacuum exhaust mechanism for transferring, to the outlet port, gas sucked from the inlet port by an interaction between the spiral plates and the stator disc, wherein outer diameters of the spiral plates on the first side of the slit are larger than outer diameters of the spiral plates on the second side of the slit, the spacers on the second side of the stator disc have a smaller inner diameter than inner diameters of the spacers on the first side of the stator disc, at least one of the spacers fixing the stator disc has a relief formation portion so that a part of an inner diameter of at least one of the spacers on the second side of the stator disc is equal to the inner diameter of the spacers on the first side of the stator disc, and the relief formation portion has an inclined portion which is inclined downstream in at least a portion of a side surface thereof opposed to one of the spiral plates.

2. The vacuum pump according to claim 1, wherein a horizontal position of a lower end of the relief formation portion coincides with a horizontal position of an upstream surface of the spiral plate which is opposed to the spacer having the relief formation portion via a predetermined gap.

* * * * *